United States Patent [19]

Bernier

[11] 4,321,569

[45] Mar. 23, 1982

[54] SEALED ELECTOMAGNETIC RELAY

[76] Inventor: Raymond Bernier, 29 Avenue Foch, 94300 Vincennes, France

[21] Appl. No.: 102,415

[22] Filed: Dec. 11, 1979

[30] Foreign Application Priority Data

Dec. 15, 1978 [FR] France ..... 78 36378

[51] Int. Cl.[3] ..... H01H 67/02

[52] U.S. Cl. ..... 335/128; 335/133; 335/202

[58] Field of Search ..... 335/127, 128, 132, 133, 335/185, 202

[56] References Cited

U.S. PATENT DOCUMENTS 3,295,078 12/1966 Hrynewycz ..... 335/128 X
3,611,218 10/1971 Fujita ..... 335/202
4,061,994 12/1977 Minks ..... 335/202

FOREIGN PATENT DOCUMENTS 2723430 11/1978 Fed. Rep. of Germany ..... 335/128
1551497 12/1968 France ..... 335/202
2181822 12/1973 France ..... 335/128

*Primary Examiner*—George Harris
*Attorney, Agent, or Firm*—Young & Thompson

[57] ABSTRACT

A miniature sealing-tight relay having components which are disposed in a plastic material casing especially suited for use as a telephone relay. The casing has a belt having walls in which a magnetic circuit, a coil and the associated connections are moulded; one or two side plates are welded to belt 1 and the fixed contacts and the components for securing and pivoting moving contacts are moulded therein.

16 Claims, 9 Drawing Figures

SEALED ELECTOMAGNETIC RELAY

Figure 1:
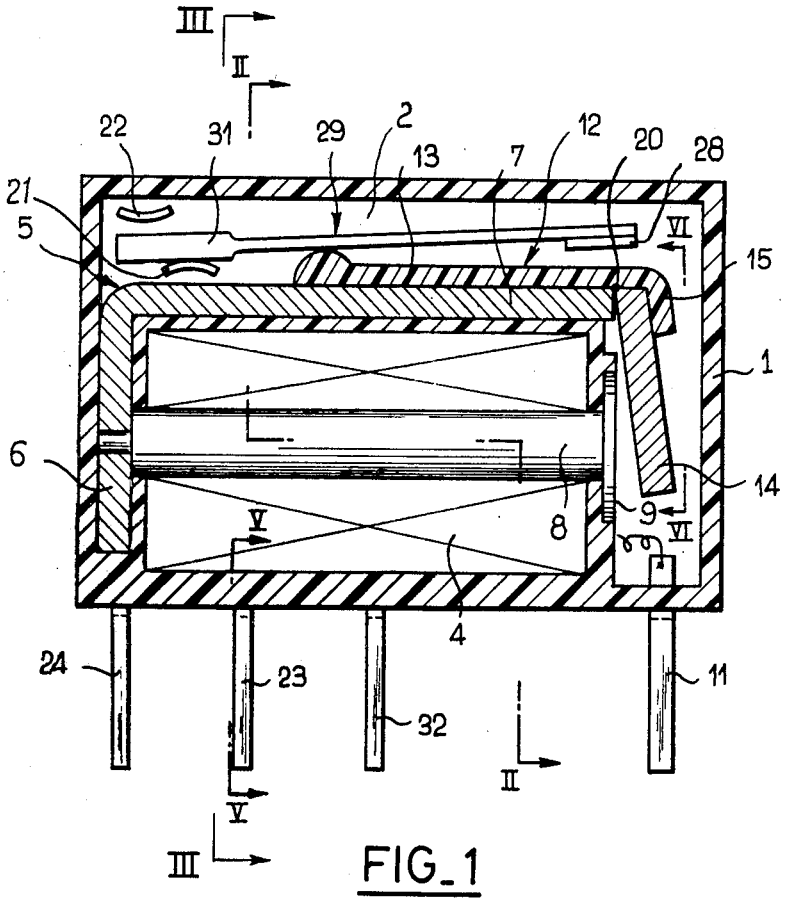

This invention relates to a sealed and, more particularly, small electromagnetic relay for use, inter alia, in telephones.

Various relay structures have been used in an attempt to solve the problems of bulk and of protecting the relay components from dust and other sources of contamination, inter alia from the material for insulating or sticking the wires of the coil, while ensuring good insulation of the conductive parts, efficient operation of the contacts and adequate magnetic efficiency. These various problems are becoming increasingly critical as the size of relays decreases, inter alia when it is required to produce a very small sealed relay having outputs adapted for example to co-operate with a grid having a standard pitch of 2.54 mm (the smallest pitch in use at the present time).

In a known "miniature" relay, the driving means are disposed in a plastics material casing made up of two half-shells surmounted by a cover. In the relay, the fixed and moving contacts are outside the half-shells and are not sealed relative to ingress of liquids. Most known sealed relays comprise a metal base to which the driving means and contacts are secured, a metal covering being welded to the base. The electrical outputs are mounted on the base and insulated therefrom by glass beads. This method is not appropriate for economic, automatic construction.

In view of the increasing use of "wave" methods of welding relays on printed circuit boards, it is becoming essential to seal the relay from the welding flux and the flow of washing liquid.

An object of the present invention is to provide a miniature sealed relay having a very simple structure and adapted to solve or at least mitigate the aforementioned problems in a satisfactory manner.

According to the present invention there is provided a sealed electromagnetic relay which comprises a casing having a number of surfaces and containing driving means comprising a winding and a magnetic circuit for actuating at least one movable conductive strip co-operating with fixed contacts and output connections projecting from the casing, at least one surface of the casing having a side plate fitted thereto, conductive bars being moulded in the side plate and extending, at one end, inside the casing to form the contacts and, at the other end, projecting outside the casing to form a part of the aforementioned connections.

The resulting casing is completely sealed, inter alia, as a result of subsequent welding of the side plate(s). The outputs of the conductive bars are also completely sealing-tight since they are moulded in the side plate(s).

In a preferred embodiment of the invention, the aforementioned conductive bars are curved in the moulding in the side plate and penetrate into the interior of the casing perpendicular to the side plate.

The ends of the bars projecting inside the casing constitute the fixed contacts. The bending inside the side plate prevents any accidental longitudinal sliding of the conductive bars after they have been moulded in.

Preferably, the ends of the conductive bars projecting inside the casing are curved, their convexity extending towards the moving conductive strip so as to facilitate contact therewith.

According to an advantageous embodiment of the invention, the aforementioned conductive bars are doubly bent (that is in the shape of a "Z") where they come out of the casing so as to be in line with connecting terminals of a relay winding. Accordingly, the set of relay connections can be inserted in the standard grid of a printed circuit board. In addition, the Z-shaped fold under the relay casing is the equivalent of a spacing member separating the casing from the board and acts as a washing pin.

In a preferred embodiment of the invention, the relay coil is moulded in the casing, together with the magnetic circuit, in a substantially parallelepipedal mass of insulating material for holding the magnetic circuit, which is L-shaped and has two branches bearing on two surfaces of the coil. A first branch of the magnetic circuit is at an angle to the coil axis and bears a magnetic core coaxial with the coil. The second branch of the circuit extends parallel to the coil and up to its end. These features ensure that the coil is efficiently secured and protected in sealing-tight manner, and that the magnetic circuit is secured in very efficient manner.

In a preferred embodiment of the invention, the relay comprises an armature which actuates the conductive strip in response to action of the coil. The armature is pivoted around an axis substantially coincident with the end of the second branch of the magnetic circuit and comprises a push arm made of non-magnetic material and extending along the second branch of the magnetic circuit. The use of a non-magnetic material avoids any loss of flux, as normally occurs in magnetic materials. It also has a certain elasticity and thus has a resilient effect on the moving conductive strips and provides a more reliable contact. Preferably, the push arm has a bent branch in which a magnetic plate is moulded. Since the actuating armature must normally have a bend, the bend is disposed in the non-magnetic part constituting the push arm and is obtained by moulding, thus avoiding the need to bend a fragile metal component. Furthermore, the metal plate is moulded inside the bend, thus electrically insulating it from moving strips disposed close to it.

According to an improved embodiment of the invention, the aforementioned armature is secured to the side plates by pivot devices, thus obtaining excellent mechanical operation.

According to another embodiment of the invention, each moving conducting strip comprises a partly flattened cylindrical rod, the cylindrical part of the rod constituting a moving contact. This feature ensures that the moving strips are sufficiently flexible and efficiently co-operate with the fixed contacts.

According to a further embodiment of the invention, each moving conductive strip is bent into a U, the cylindrical ends of the strip forming a turn contact, thus greatly improving the probability of a good contact.

Figure 2:
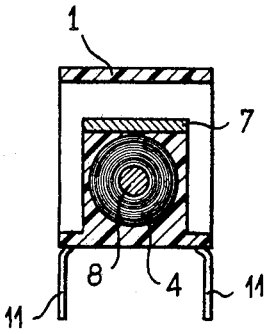
Figure 3:
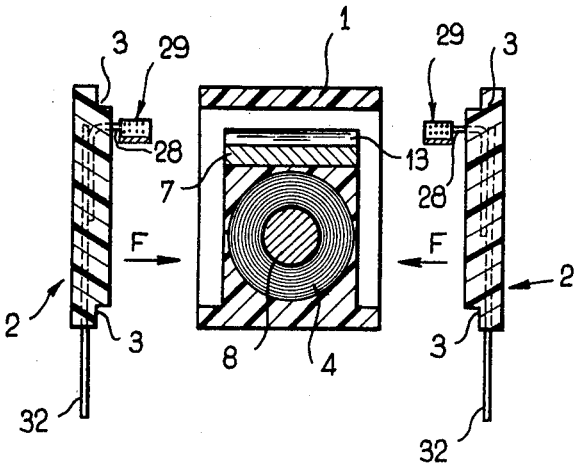
Figure 4:
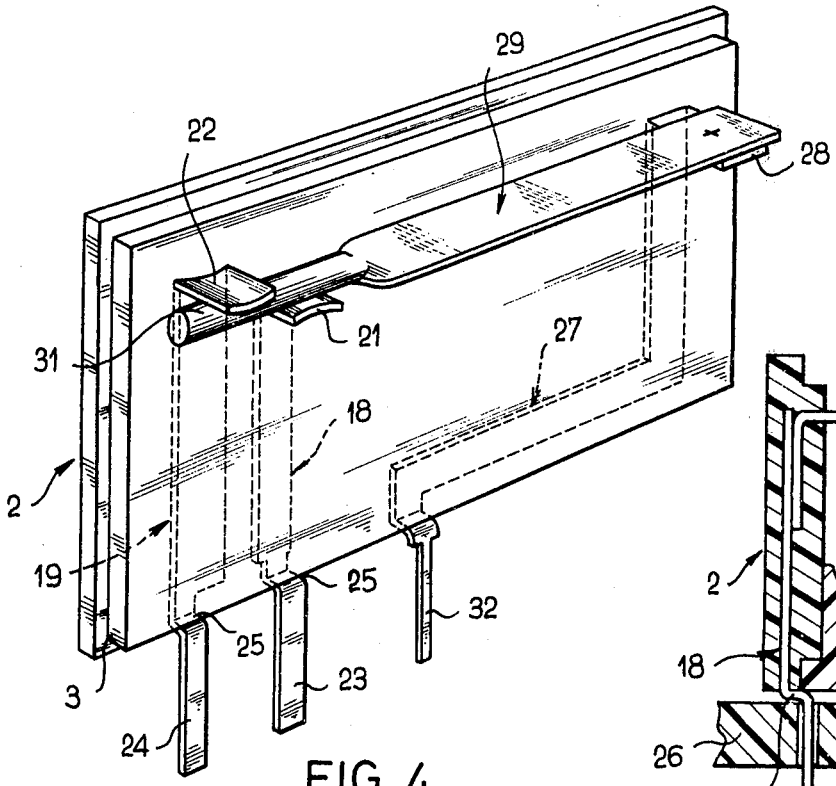
Figure 5:
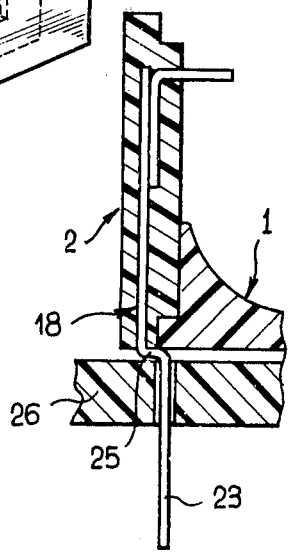
Figure 6:
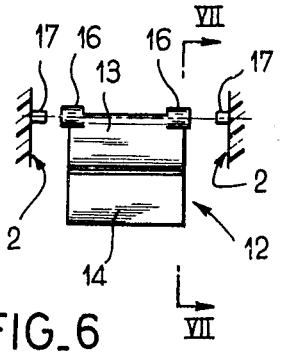
Figure 7:
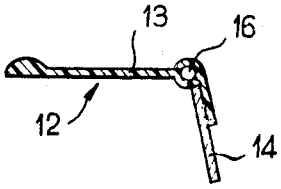
Figure 8:
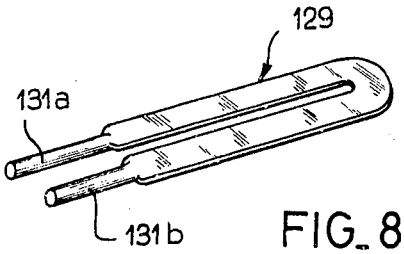
Figure 9:
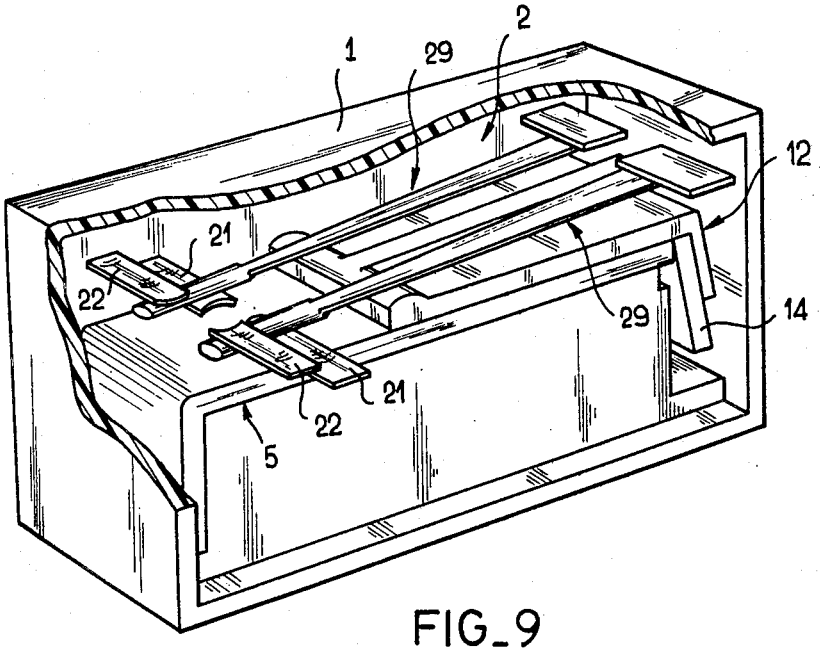

For a better understanding of the present invention and to show how the same may be put into effect, reference will now be made, by way of example, to the accompanying drawings, in which:

FIG. 1 shows a longitudinal sectional view of a relay in accordance with the invention, FIG. 2 shows a sectional view along II—II of FIG. 1, after the side plates have been removed, FIG. 3 shows a sectional view along III—III of FIG. 1, during manufacture, when the side plates are fitted in, FIG. 4 shows a perspective view of a side plate and all its fittings, FIG. 5 shows a view, partly in section, along V—V of FIG. 1, FIG. 6 shows an exploded, sectional view along VI—VI in FIG. 1, FIG. 7 shows a sectional view along VII—VII in FIG. 6, FIG. 8 shows a perspective view of an embodiment of a moving strip and FIG. 9 is a partly cut-away perspective view of a relay in accordance with the invention.

FIGS. 1 to 5 show a relay comprising a plastics material casing comprising a belt 1 and two side plates 2 fitted into two surfaces of the casing by means of shoulders 3 (see FIGS. 3 and 4).

A coil 4 is moulded in belt 1, the moulding being substantially parallelepipedal. The moulding includes an L-shaped magnetic circuit 5 having a first branch 6 extending at an angle to the coil and a second branch 7 extending parallel to the coil 4 and as far as its end.

A core 8 coaxial with the coil 4, is secured at one end to branch 6 of circuit 5, whereas its other end has a widened pole portion 9. The wire of the coil 4 is connected to output connections 11 projecting under the relay and moulded in belt 1.

The previously-described assembly, except for plates 2, is completely moulded with belt 1.

A moving armature 12 comprises a magnetic plate 14 and a push arm 13 made of relatively flexible plastics material. The arm 13 has a bent end 15 and the plate 14 and the arm 13 are moulded inside the bend.

Near the bend 15, the arm 13 has two lateral bearings 16 co-operating with pivots 17 formed in the side plates 2 near the free end of the magnetic circuit 5 (see FIGS. 6 and 7). The bearings are positioned so that the axis which they define coincides with the ideal theoretical axis of rotation 20 of plate 14 (see FIG. 1). The bend 15 is at an angle slightly greater than 90° and the pivots 17 are disposed so that the arm 13 extends along the branch 7 of the circuit 5, the plate 14 being spaced apart from the widened portion 9.

Two conductive bars 18, 19 are moulded in the two side plates 2 and are bent inside the moulding so as to project inside the casing at right angles to the side plates and formed fixed contacts 21 and 22, respectively. In the embodiment shown in FIG. 3, the terminals are in two parts corresponding to different metals, but this does not modify the method of bending.

The other ends of the bars 18 and 19 come out at the bottom of the relay, at the edge of sideplate 2, to form connecting lugs 23 and 24, respectively.

At the place where they come out of the side plates, the bars 18 and 19 have a double curve ("Z") so that the lugs 23 and 24 are in line with the winding connections 11. The double curve produces a fold 25 which forms a spacer so as to hold the relay slightly away from a printed circuit board 26 to which it is secured. Accordingly, the folds act as "washing pins" after welding (see FIG. 5).

A third conductive bar 27 projects at both ends in the same manner as the preceding bars. At its end 28 inside the casing, a moving conductive strip 29 is welded, the strip being made of partly flattened round wire. A cylindrical part 31 of the strip 29 is inserted between contacts 21 and 22, which are suitably offset for the purpose. To obtain better contact, the projecting parts 21 and 22 are curved (see FIG. 4), their convexity extending towards the strip 29.

In an alternate embodiment, the moving strip can comprise a round wire 129 curved into a U and flattened except at its ends 131*a* and 131*b* (see FIG. 8). This doubling of the contacts greatly improves the probability of an efficient contact.

In another embodiment of the invention, the connecting lugs of the bars 18, 19 and 27 are made thin as shown in the case of the lug 32 (see FIG. 4). By means of this feature, a double bend ("Z") can be formed in a wide, strong part of the conductive terminal, and a small lug can be formed and easily inserted in a conventional orifice in a printed circuit board; the spacing between the relay and board 26, which depends on the length of the thin portion, can be greater than that formed by the fold 25.

The fixed or inoperative contact 21 is disposed so that the moving contact 31 bears on it when the relay is inoperative (see FIG. 1), that is when the coil 4 and, therefore, the magnetic plate 14 are not actuated.

When coil 4 is actuated, the plate 14 is attracted by the widened portion 9 and the armature 12 pivots around the side pivots thereof. The push arm 13 then raises the strip 29 so that the moving contact 31 bears against the fixed or operating contact 22. The angular travel of armature 12 is made slightly greater than the necessary amount, so as to obtain a good contact in the operating position, the excess travel being absorbed by the elasticity of the strip 29 and the push arm 13.

In the operating position, no loss of flux is produced by the armature 12, since the push arm 13, disposed near the coil, is of non-magnetic material.

Although the magnetic plate 14 is near the electric circuit comprising the strip 29, the plate 14 is covered by the bent folded part 15, thus ensuring excellent electrical insulation.

Relays may be manufactured by preparing three moulded assemblies in accordance with the methods of the prior art. A first assembly comprises the belt 1, the coil 4, the associated connections 11, the magnetic circuit 5 and the core 8. A second assembly comprises the armature 12 and the push arm 13 moulded on the plate 14. This component is formed by moulding, thus avoiding the need to bend a relatively fragile metal component. Finally, a third assembly is made of one (or two) side plates 2 in which conductive bars are moulded.

After armature 12 has been suitably positioned, the side plate(s) 2 is/are fitted in in the direction of arrows F (see FIG. 3), then welded in known manner. Finally, the lugs 23, 24 and 32 are bent into a Z as previously explained so as to dispose them at the same pitch as the coil connections 11, for example at a pitch of 2.54 mm. The resulting relay is completely sealed and is very suitable for automatic manufacture.

I claim:

1. In a sealed electromagnetic relay comprising a casing having a number of surfaces and containing driving means comprising a winding and a magnetic circuit for actuating at least one movable conductive strip cooperating with fixed contacts and output connections projecting from the casing, the improvement which comprises at least one surface of the casing having a side plate fitted thereto, conductive bars moulded in the side plate and extending at one end inside the casing to form said contacts and at the other end projecting outside the casing to form a part of the aforementioned connections, said conductive bars having a bend which is disposed within the moulded material of the side plate and penetrating into the interior of the casing perpendicular to the side plate.

2. The relay of claim 1, in which the conductive bars are in two parts which are joined together inside the moulding and which are made of different metals.

3. The relay of claim 1, in which the ends of the conductive bars projecting into the casing and relative to the fixed contacts are curved and have their convexity facing the movable conductive strip.

4. The relay of claim 1, in which the conductive strip associated with the movable contact has a part which projects into the casing and bears the movable conductive bar.

5. The relay of claim 1, in which the conductive bars are doubly bent where they come out of the casing so as to be in line with terminals for connecting the relay winding.

6. The relay of claim 1, in which the relay winding is moulded in the casing together with the magnetic circuit.

7. The relay of claim 6, in which the magnetic circuit is L-shaped and the two branches of the L bear on two moulding surfaces of the coil.

8. The relay of claim 6, in which a first arm of the magnetic circuit is at an angle to the axis of the coil and bears a magnetic core coaxial with the coil and a second arm of the magnetic circuit extends parallel to the coil up to the end thereof.

9. The relay of claim 6, which comprises an armature which actuates the conductive strip in response to action of the coil, the armature being pivoted around a theoretical axis substantially coinciding with the end of the second branch of the magnetic circuit and comprising at least one push arm made of non-magnetic material and extending along the second branch.

10. The relay of claim 9, in which the push arm is made of resilient material.

11. The relay of claim 9, in which the push arm has a bent branch in which a magnetic plate is moulded.

12. The relay of claim 9, in which the armature is secured to the side plates by pivot devices.

13. The relay of claim 12, in which the pivot devices are positioned so that their common axis coincides with the theoretical axis.

14. The relay of claim 1, in which said at least one movable conductive strip comprises a partially flattened cylindrical rod, the cylindrical part of the rod constituting a movable contact.

15. The relay of claim 14, in which each twin conductive strip is bent into a U, the cylindrical ends of the strip constituting a movable contact.

16. The relay of claim 1, said casing comprising an integral rectangular frame having two sides closed by said side plates.

* * * * *